US010670271B2

(12) United States Patent
Abu-Irshaid

(10) Patent No.: US 10,670,271 B2
(45) Date of Patent: Jun. 2, 2020

(54) ACOUSTIC DAMPENING LINER CAP AND GAS TURBINE COMBUSTOR INCLUDING THE SAME

(71) Applicant: Doosan Heavy Industries & Construction Co., Ltd., Gyeongsangnam-do (KR)

(72) Inventor: Esam Abu-Irshaid, Lake Worth, FL (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 286 days.

(21) Appl. No.: 15/282,331

(22) Filed: Sep. 30, 2016

(65) Prior Publication Data

US 2018/0094815 A1 Apr. 5, 2018

(51) Int. Cl.
*F23R 3/16* (2006.01)
*F23R 3/00* (2006.01)

(52) U.S. Cl.
CPC ..... *F23R 3/16* (2013.01); *F23R 3/002* (2013.01); *F23R 2900/00014* (2013.01); *F23R 2900/03044* (2013.01)

(58) Field of Classification Search
CPC .. F23R 3/00; F23R 3/002; F23R 3/007; F23R 3/04; F23R 3/045; F23R 3/06; F23R 3/10; F23R 3/14; F23R 3/16; F23R 3/28; F23R 3/283; F23R 3/286; F23R 3/34; F23R 3/343; F23R 3/346; F23R 3/36; F23R 2900/00014; F05D 2270/14; F05D 2260/96; F05D 2260/963; F05D 2260/964
See application file for complete search history.

(56) References Cited

U.S. PATENT DOCUMENTS 5,575,144 A 11/1996 Brough
5,685,157 A 11/1997 Pandalai et al.
6,351,947 B1 * 3/2002 Keller ..... F23R 3/002 60/725
8,438,851 B1 * 5/2013 Uhm ..... F23R 3/04 60/737
9,476,592 B2 * 10/2016 Berry ..... F23R 3/10
9,835,333 B2 * 12/2017 Antoniono ..... F23R 3/10
2004/0211185 A1 * 10/2004 Young ..... F23R 3/002 60/725
2005/0034918 A1 * 2/2005 Bland ..... F23M 20/005 181/250
2005/0223707 A1 * 10/2005 Ikeda ..... F23R 3/04 60/725
2006/0123791 A1 * 6/2006 Macquisten ..... F23M 20/005 60/725

(Continued)

*Primary Examiner* — William H Rodriguez
(74) *Attorney, Agent, or Firm* — Invenstone Patent, LLC

(57) ABSTRACT

A gas turbine combustor includes a combustion chamber, a liner adjacent to the combustion chamber, a liner cap capping the combustion chamber, and a swirler cup passing through the liner cap. The liner cap includes a first cavity having a first inlet receiving an air, a second cavity having a first outlet facing the combustion chamber, and an impingement plate between the first cavity and the second cavity. The air flows from the first inlet to the combustion chamber through the first cavity, the impingement plate, and the second cavity.

12 Claims, 8 Drawing Sheets

(56) References Cited

U.S. PATENT DOCUMENTS

| | | | | |
|---|---|---|---|---|
| 2008/0087019 | A1* | 4/2008 | Macquisten | F23R 3/002 60/725 |
| 2010/0021291 | A1* | 1/2010 | Beeck | F01D 5/143 415/207 |
| 2011/0265484 | A1* | 11/2011 | Huber | F23R 3/002 60/755 |
| 2013/0019602 | A1 | 1/2013 | Kim et al. | |
| 2013/0104552 | A1* | 5/2013 | Uhm | F23R 3/002 60/738 |
| 2013/0269350 | A1* | 10/2013 | Khan | F23R 3/286 60/737 |
| 2013/0305725 | A1* | 11/2013 | Berry | F23R 3/14 60/746 |
| 2013/0305739 | A1* | 11/2013 | Berry | F23R 3/283 60/785 |
| 2013/0318977 | A1* | 12/2013 | Berry | F23R 3/283 60/739 |
| 2015/0020498 | A1* | 1/2015 | Schilp | F23R 3/002 60/39.83 |
| 2018/0038282 | A1* | 2/2018 | Kugimiya | F01D 25/00 |
| 2018/0156461 | A1* | 6/2018 | Theuer | F23R 3/002 |
| 2018/0180288 | A1* | 6/2018 | Kugimiya | F23R 3/002 |

* cited by examiner

ACOUSTIC DAMPENING LINER CAP AND GAS TURBINE COMBUSTOR INCLUDING THE SAME

BACKGROUND

The present invention relates to a damping device for a gas turbine combustor, more particularly, to a liner cap to control damping of the gas turbine combustor. The gas turbine combustor comprises a compressor, a liner, a fuel injector, and a combustion chamber. The compressor provides compressed air through the liner, and the fuel injector supplies the combustion chamber with a fuel gas for combustion. The compressed air and the fuel gas are mixed and provided to the combustion chamber, and then the fuel gas is combusted in the combustion chamber. After the combustion, a hot gas generated in the combustion chamber is supplied to a turbine blade of a turbine. However, the combustion of the fuel gas in the combustion chamber also makes a combustion vibration or an acoustic vibration. The acoustic vibration can make a noise, a crack, or a mechanical stress of the gas turbine combustor.

Damping devices have been disclosed for gas turbine combustors to solve the acoustic vibration problem. For example, the damping systems disclosed in U.S. Pat. Nos. 5,575,144 and 5,685,157 provide an external damping device disposed on the outside of the gas turbine combustor and communicating with a case of the gas turbine combustor. However, these damping systems are complex and make the gas turbine combustor bigger.

BRIEF SUMMARY

Exemplary embodiments of the subject invention relate to a gas turbine combustor that substantially obviates one or more of the above disadvantages/problems and provides one or more of the advantages as mentioned below. In many embodiments, a gas turbine combustor comprises a liner cap absorbing an acoustic vibration originating in a combustion chamber.

In one embodiment, a gas turbine combustor includes a first cavity having a first inlet; a second cavity disposed on the first cavity and having a first outlet; and a combustion chamber disposed on the first outlet of the second cavity.

In a further embodiment, the gas turbine combustor includes an impingement plate disposed between the first cavity and the second cavity.

Preferably, the impingement plate includes a plurality of through holes.

In a further embodiment, the gas turbine combustor also includes a liner connected to the first inlet.

Preferably, the liner provides a compressed air to the first inlet.

In a further embodiment, the gas turbine combustor also includes a swirler cup disposed on the first cavity and the second cavity.

In a further embodiment, the gas turbine combustor includes a fuel injector located in the swirler cup.

In a further embodiment, the gas turbine combustor includes a vane located in an inside of the swirler cup and, at an outside of the fuel injector.

Preferably, the vane provides air supplied by the liner and a fuel supplied by the fuel injector to the combustion chamber through the swirler cup.

Preferably, a cooling gas is provided to the first inlet.

In another embodiment, a liner cap comprises a first cavity including a first inlet; a second cavity including a first outlet facing a combustion chamber; and an impingement plate between the first cavity and the second cavity. An air passage may form from the first inlet to the first outlet through the first cavity, the impingement plate, and the second cavity.

Preferably, the first cavity and the second cavity absorb acoustic vibrations generated in the combustion chamber.

Preferably, a volume of the first cavity is larger than a volume of the second cavity.

Preferably, the acoustic vibrations have a plurality of frequency peaks.

Preferably, the first cavity corresponds to the acoustic vibration having a lower, frequency peak of the plurality of frequency peaks and the second cavity corresponds to the acoustic vibration having a higher frequency peak of the plurality of frequency peaks.

Preferably, the impingement plate has a plurality of first through holes, the first outlet has a plurality of second through holes, and each of the first through holes is larger than each of the second through holes.

In a further embodiment the second cavity includes a second outlet facing an outside of the combustion chamber.

In another embodiment, a gas turbine comprises a combustion chamber; a liner adjacent to the combustion chamber; a liner cap capping the combustion chamber; and a swirler cup passing through the liner cap. The liner cap includes a first cavity having a closed plate and an open plate opposite to the closed plate and a second cavity disposed between the open plate of the first cavity and the combustion chamber.

In a further embodiment, the gas turbine further comprises a turbine blade configured to receive a hot gas from the combustion chamber and a case encapsulating the liner cap and the swirler cup.

Preferably, the liner provides a first portion of air to the first cavity and a second portion of air to the swirler cup.

DETAILED DISCLOSURE

Figure 1:
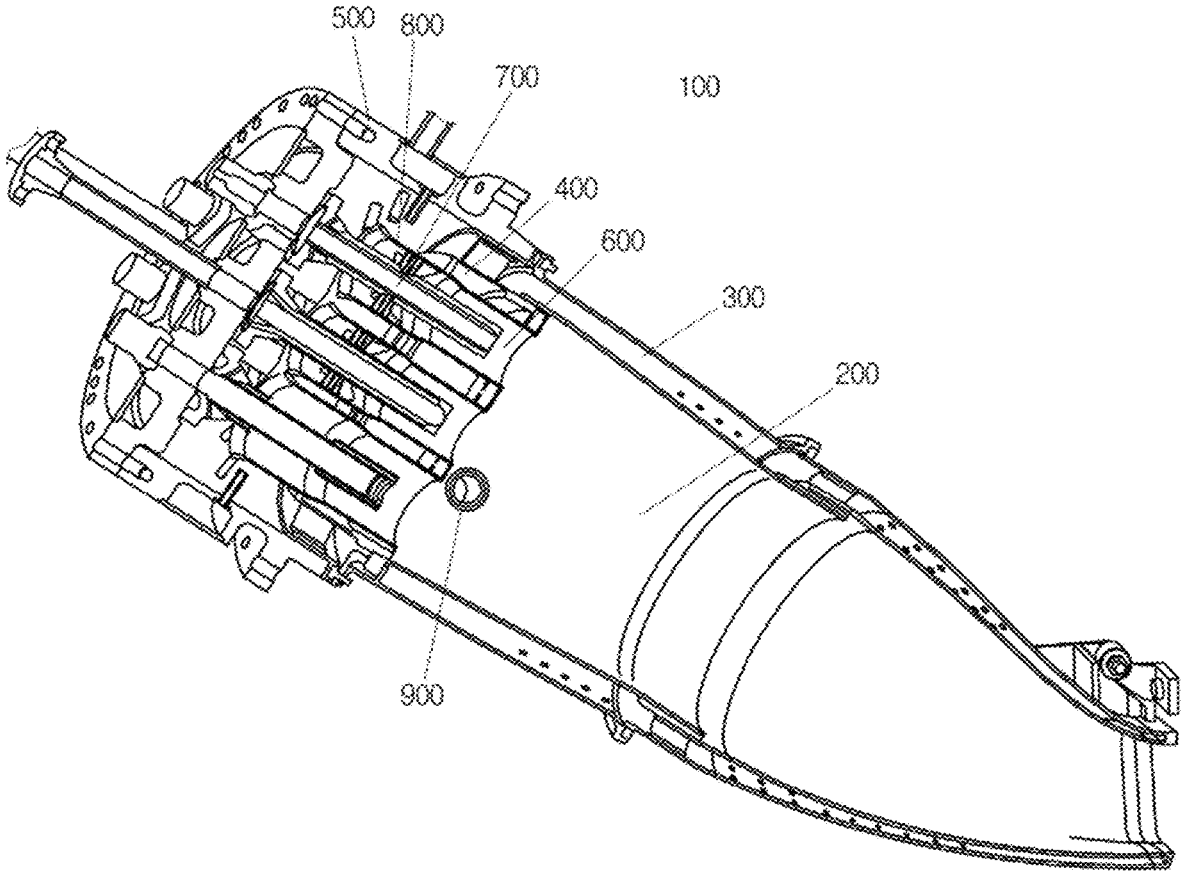
FIG. 1 is a cross-sectional perspective view of a gas turbine combustor according to a first embodiment of the subject invention.

When the term "on" or "over" are used herein, when referring to layers, regions, patterns, or structures, it is understood that the layer, region pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present.

In addition, references to "first", "second", and the like (e.g., first and second portion), as used herein, and unless otherwise specifically stated, are intended to identify a particular feature of which there may be more than one. Such reference to "first" does not imply that there must be two or more. These references are not intended to confer any order in time, structural orientation, or sidedness (e.g., left or right) with respect to a particular feature, unless explicitly stated. In addition, the terms "first" and "second" can be selectively or exchangeably used for the members.

Furthermore, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated. That is, a dimension of each of the elements may be exaggerated for clarity of illustration, and the dimension of each of the elements may be different from an actual dimension of each of the elements. Not all elements illustrated in the drawings must be included and limited to the present disclosure, but the elements except essential features of the present disclosure may be added or deleted.

It is to be understood that the figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Now, the gas turbine combustor according to exemplary embodiments of the present invention will be described in detail with reference to the accompanying drawings.

Figure 2:
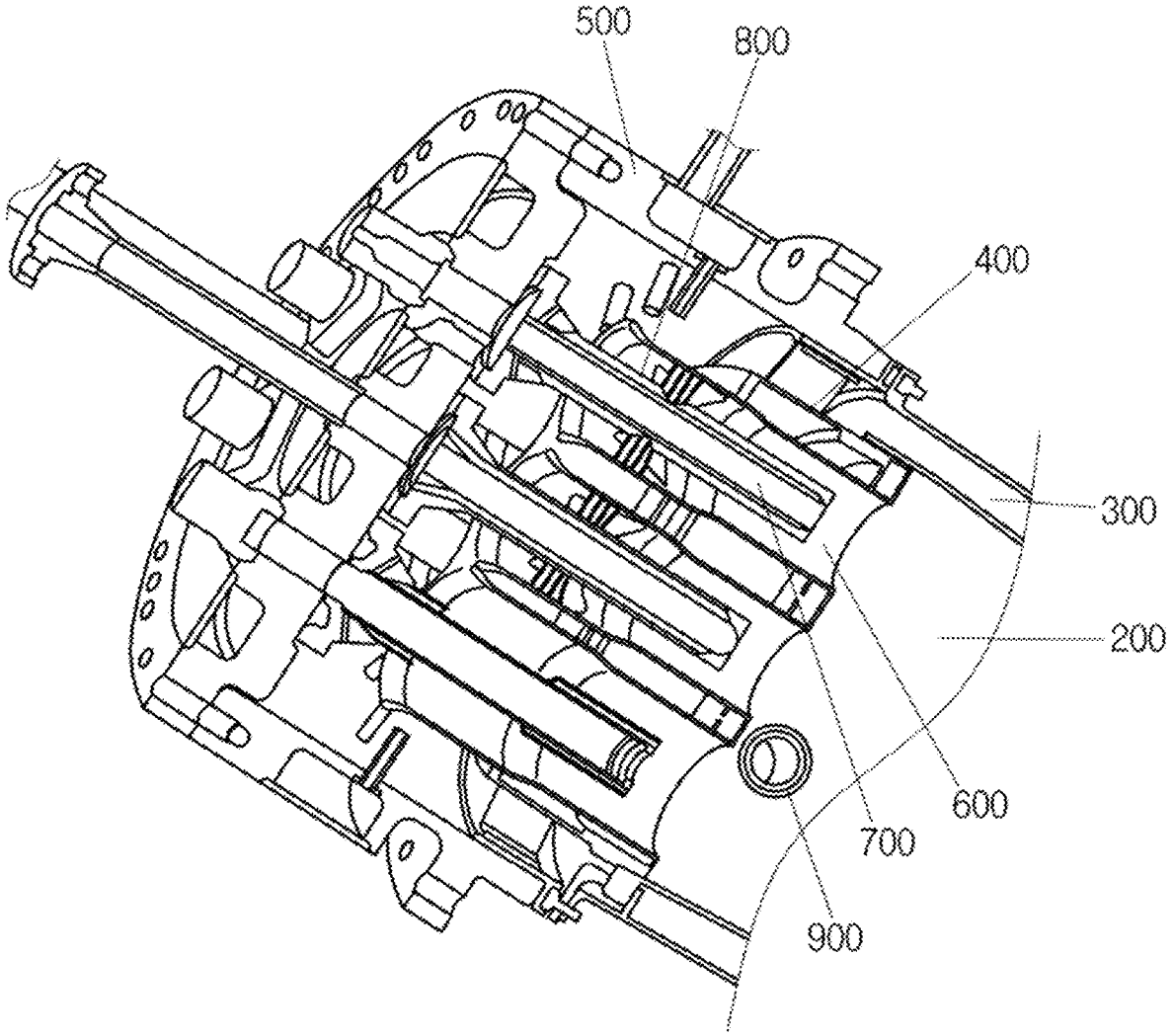
FIG. 2 is an enlarged cross-sectional perspective view in FIG. 1.

FIG. 1 is a cross-sectional perspective view of a gas turbine combustor according to a first embodiment of the subject invention and FIG. 2 is an enlarged cross-sectional perspective view in FIG. 1. Referring to FIG. 1 and FIG. 2, a gas turbine combustor 100 may include a combustion chamber 200, a liner 300, a liner cap 400, and a case 500. The gas turbine combustor 100 further includes a swirler cup 600, a fuel injector 700, and a vane 800 located in an inner side of the case 500. In addition, an ignitor 900 is located in the combustion chamber 200.

The liner 300 is disposed adjacent to the combustion chamber 200 and provides a compressed air. The majority of the compressed air provided by the liner 300 is supplied into the inner side of the case 500 and then flows into the combustion chamber 200 through the vane 800 and the swirler cup 600.

The fuel injector 700 provides a fuel to the combustion chamber 200 through the vane 800 and the swirler cup 600. That is, the compressed air provided by the liner 300 and the fuel provided by the fuel injector 700 are mixed by the vane 800 and provided to the combustion chamber 200 through the swirler cup 600.

The ignitor 900 ignites the fuel mixed with the compressed air in the combustion chamber 200. According to the ignition of the ignitor 900, the combustion occurs in the combustion chamber 200, and then a hot gas is generated in the combustion chamber 200. However, in addition to the intended combustion, an acoustic vibration also results as a by-product of the combustion. The resulting acoustic vibration may have multiple frequency peaks.

A portion of the compressed air provided by the liner 300 is supplied into the liner cap 400 and flows into the combustion chamber 200 through the liner cap 400. This compressed air exiting from the liner cap 400 inhibits the hot gas made by the combustion from making contact with the liner cap 400 by pushing the hot gas away from the liner cap 400. As a result, the hot gas is supplied from the combustion chamber 200 to a turbine blade (not shown) of a gas turbine and used to turn the turbine blade. While the compressed air flows through the liner cap 400, the liner cap 400 absorbs the acoustic vibration and functions as a damping device that reduces or eliminates the acoustic vibration. In certain embodiment, the liner cap 400 may not receive the compressed air from the liner 300, but may receive air from another source. The compressed air from the liner 300 or the air from another source may be a cooling air.

The liner cap 400 has a cylinder shape and caps a top portion of the combustion chamber 200. A plurality of swirler cups 600 having a cylinder shape pass through the liner cap 400. The number of swirler cups 600 in the gas turbine combustor 100 of the subject invention can be seven, though embodiments are not limited thereto.

Figure 3:
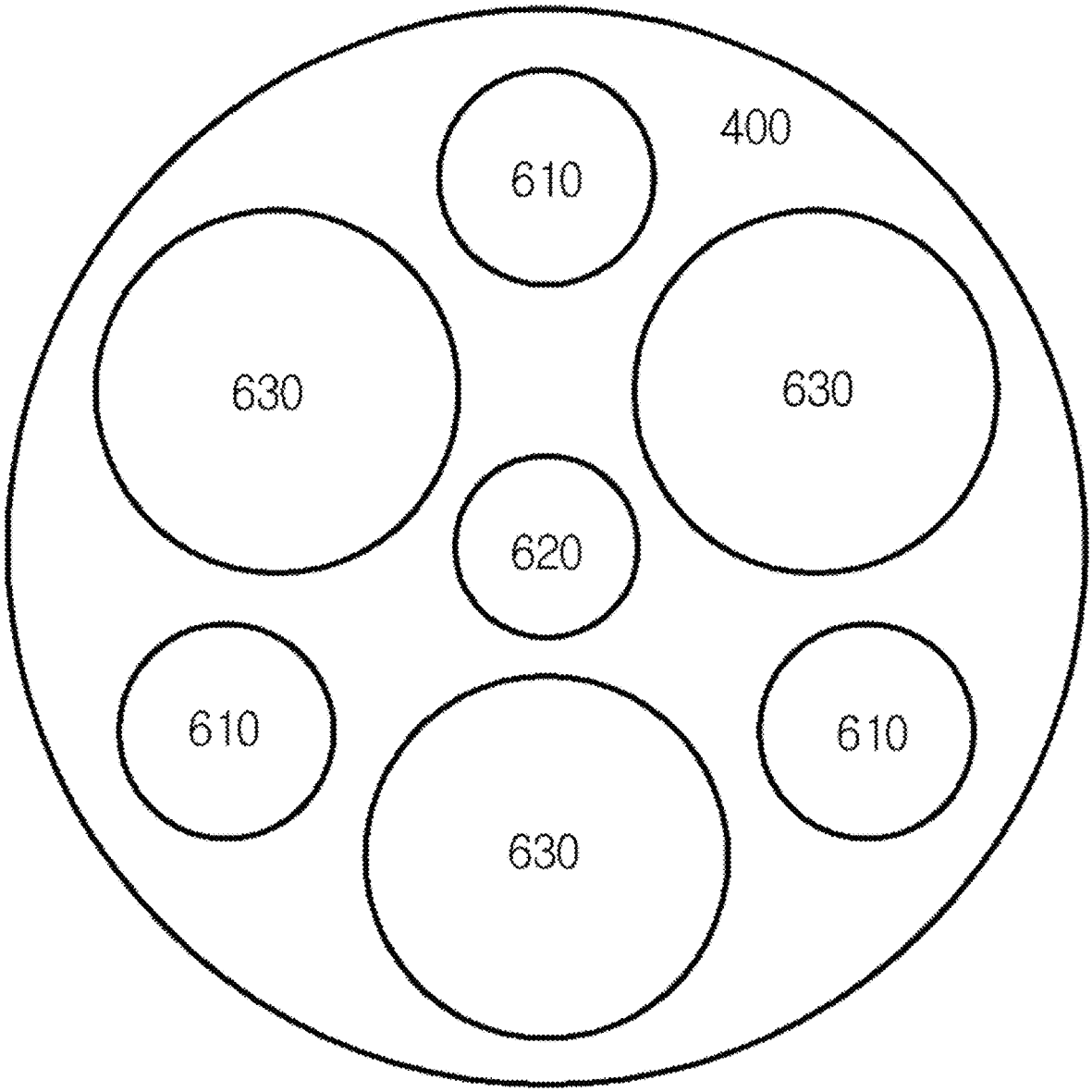
FIG. 3 is a crosswise cross-sectional diagram of a gas turbine combustor according to the first embodiment of the subject invention.
Figure 4:
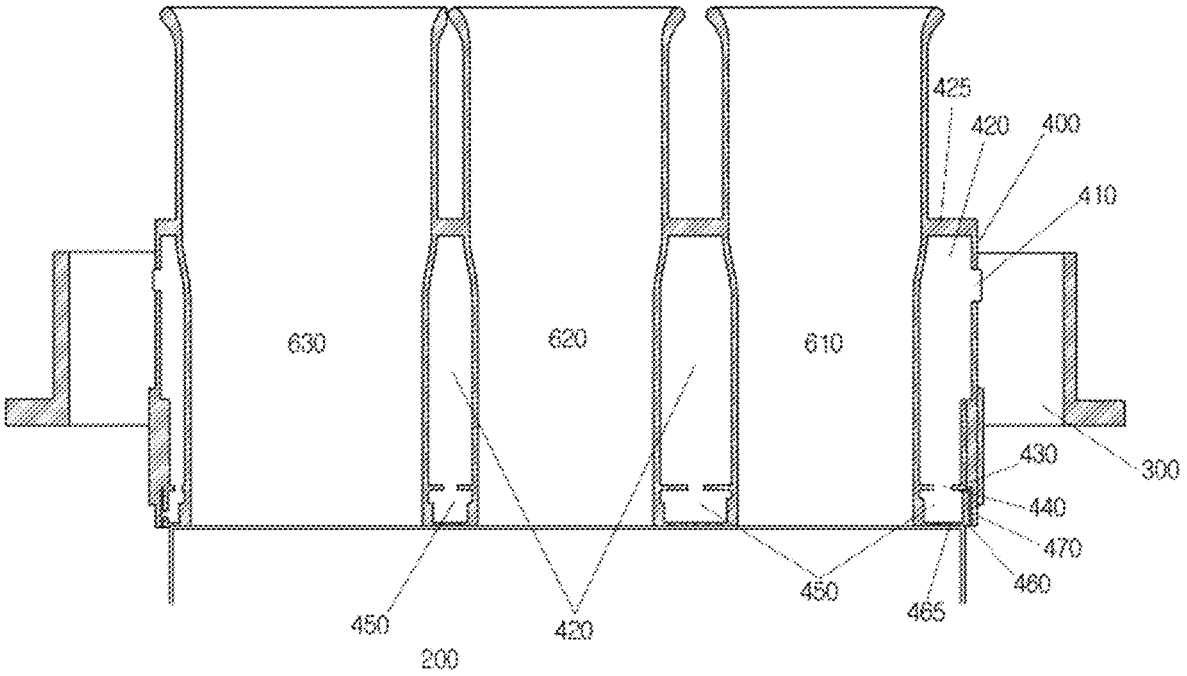
FIG. 4 is a longitudinal cross-sectional diagram of a gas turbine combustor according to the first embodiment of the subject invention.

FIG. 3 and FIG. 4 show a crosswise cross-sectional diagram and a longitudinal cross-sectional diagram of a gas turbine combustor according to the first embodiment of the subject invention, respectively. Referring to FIG. 3 and FIG. 4, the swirler cup 600 includes a plurality of swirler cups. In particular, the swirler cup 600 comprises a first swirler cup 610, a second swirler cup 620, and a third swirler cup 630. The sizes of the first swirler cup 610, the second swirler cup 620, and the third swirler cup 630 are different from each other. Though as depicted here the swirler cup 600 comprises seven swirler cups including three middle size first swirler cups 610, one small size second swirler cup 620, and three big size third swirler cups 630, embodiments are not limited thereto.

Figure 5:
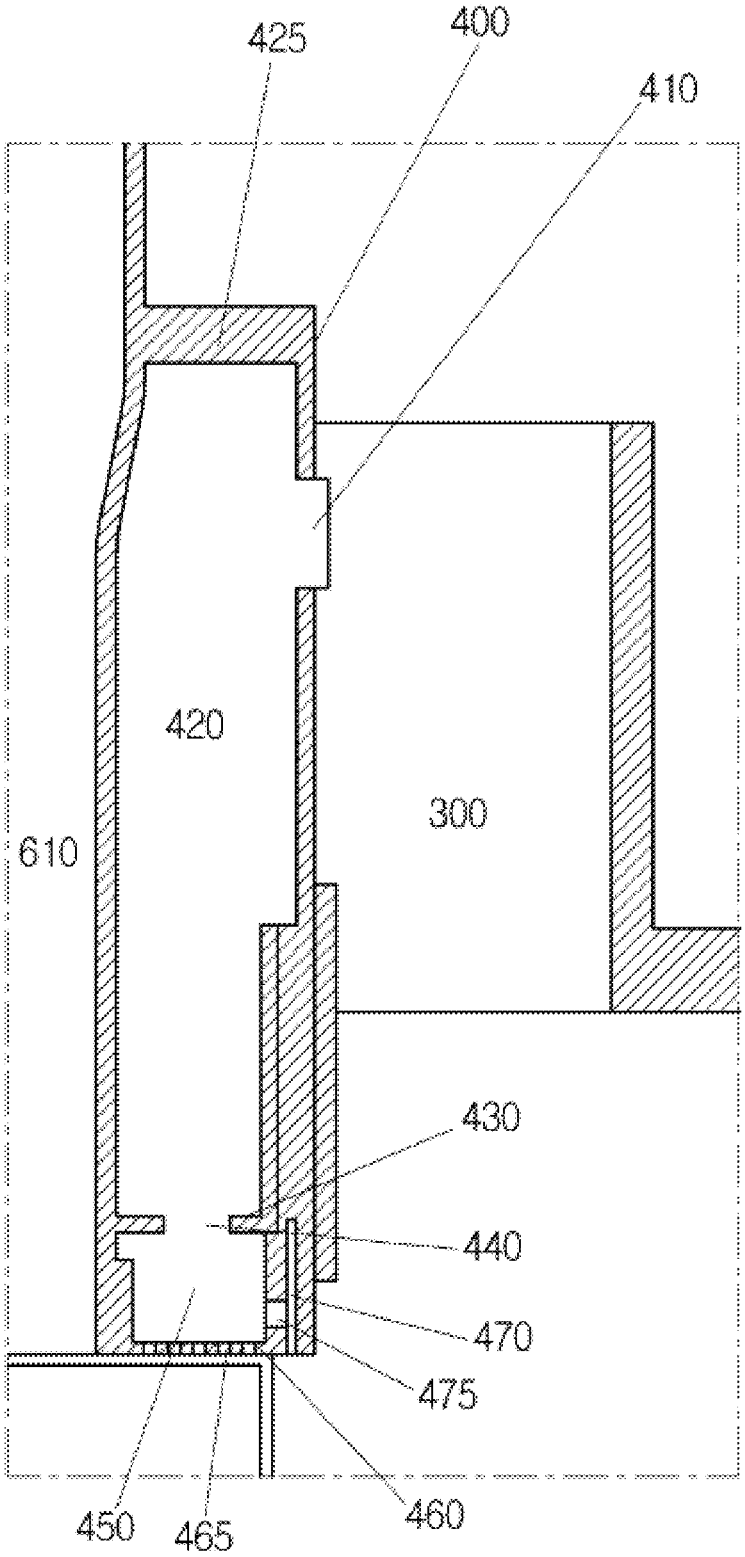
FIG. 5 is an enlarged cross-sectional diagram in FIG. 4.

FIG. 4 and FIG. 5 are longitudinal cross-sectional diagrams showing a gas turbine combustor according to the first embodiment of the subject invention. Referring to FIG. 4 and FIG. 5, the liner cap 400 includes a first cavity 420, a second cavity 450, and an impingement plate 430 between the first cavity 420 and the second cavity 450. The first cavity 420 receives compressed air from the liner 300 through a first inlet 410. For example, the compressed air in a range of from 0% to 20% to the total compressed air of the liner 300 flows into the first inlet 410 of the first cavity 420. The first cavity 420 further includes a closed plate 425 located opposite to the second cavity 450. Thus, all compressed air in the first cavity 420 flows into the second cavity 450 through a plurality of first through holes 440 of the impingement plate 430.

The second cavity 450 includes a first outlet 460 that faces the combustion chamber 200 and that includes a plurality of second through holes 465. The second cavity 450 receives the compressed air from the first cavity 420 and supplies the compressed air to the combustion chamber 200 through the second through holes 465 of the first outlet 460. Each of the second through holes 465 of the first outlet 460 is smaller than each of the first through holes 440 of the impingement plate 430. However, the number of the second through holes 465 of the first outlet 460 is larger than the number of the first through holes 440 of the impingement plate 430. In addition, the second cavity 450 further includes a second outlet 470 that is connected to the outside of the combustion chamber 200. That is, a portion of the compressed air in the second cavity 450 may exit to the outside of the combustion chamber 200. The second outlet 470 includes a plurality of third through holes 475, and the size of each of the third through holes 475 is smaller than the size of the first through holes 440 of the impingement plate 430, but larger than the size of the second through holes 465 of the first outlet 460. The number and the size of the through holes are not limited and may be different.

A volume of the first cavity 420 is larger than a volume of the second cavity 450. The first cavity 420 absorbs an acoustic vibration having a lower frequency peak, for example, below 1000 Hz, and the second cavity 450 absorbs an acoustic vibration having a higher frequency peak, for example, over 1000 Hz. However, these volume sizes and frequency peaks of the first cavity 420 and, the second cavity 450 are not limited and may have different volumes and different frequency peaks. The volumes of the first cavity 420 and the second cavity 450 can be easily controlled by moving the impingement plate 430 back and forth.

In the first embodiment of the subject invention, the liner cap 400 incorporates a damping device that reduces or eliminates an acoustic vibration by forming the first cavity 420 and the second cavity 450 in an inner side of the liner cap 400. That is, the gas turbine combustor 100 can include the damping device that is accomplished in the liner cap 400 without increasing a volume of the gas turbine combustor.

Figure 6:
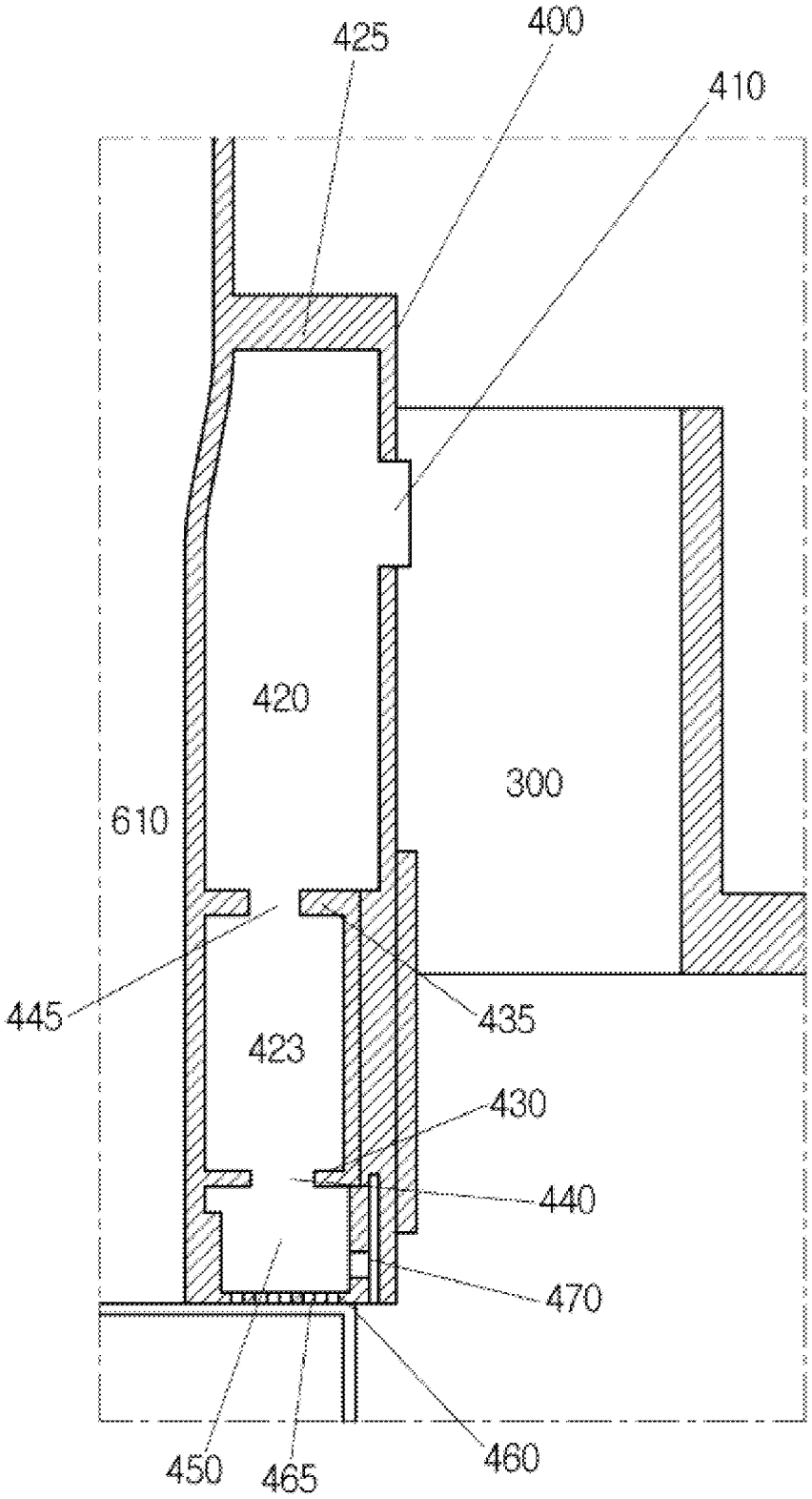
FIG. 6 is a longitudinal cross-sectional diagram of a second embodiment of the subject invention.

FIG. 6 shows a longitudinal cross-sectional diagram of a second embodiment of the subject invention. Referring to FIG. 6, the liner cap 400 further comprises a third cavity 423 between the first cavity 420 and the second cavity 450. The first cavity 420 and the third cavity 423 are divided by a middle impingement plate 435. Air within the first cavity 420 flows into the third cavity 423 through a plurality of middle through holes 445 formed in the middle impingement plate 435. The third cavity 423 absorbs an acoustic vibration having a frequency peak different from frequency peaks corresponding to the first cavity 420 and the second cavity 450. Each of the middle through holes 445 is larger than each of the first through holes 440 and each of the second through holes 465, but is smaller than the first inlet 410. However, the size of the middle through holes 445 is not limited and may be different. Furthermore, another embodiment of the subject invention includes more cavities in order to absorb an acoustic vibration having multiple frequency peaks.

Figure 7:
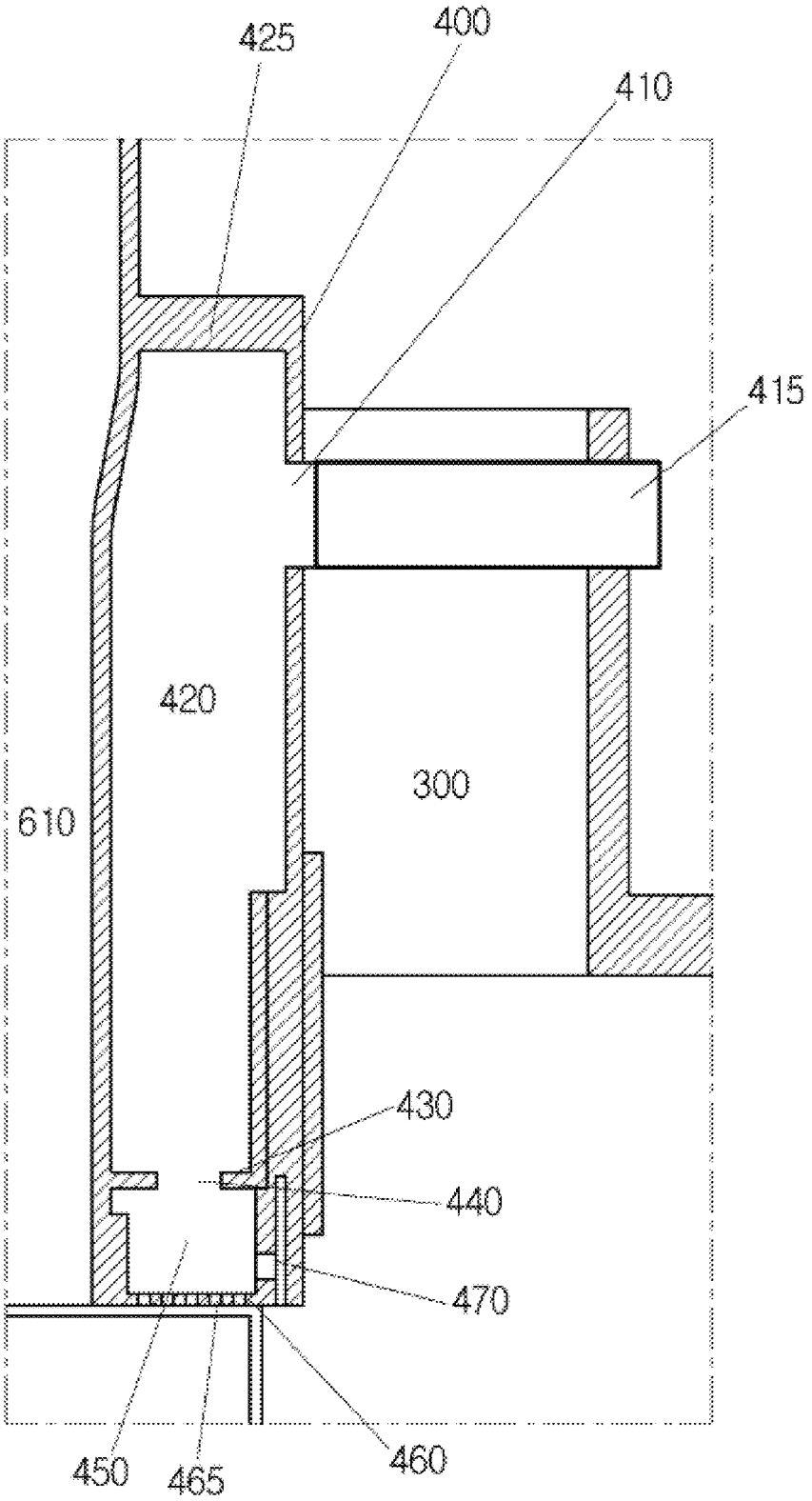
FIG. 7 is a longitudinal cross-sectional diagram of a third embodiment of the subject invention.

FIG. 7 shows a longitudinal cross-sectional diagram of a third embodiment of the subject invention. Referring to FIG. 7, the first inlet 410 of the first cavity 420 is connected to an outer air source 415, but is not connected to the liner 300. Thus, the first cavity 420 receives air from the outer air source 415, which is independent from the liner 300. As a result, the compressed air in the liner 300 flows totally into the inner space of the case 500 and is mixed with the fuel provided by the fuel injector 700 for combustion in the combustion chamber 200. The air provided by the outer air source 415 is controlled for the purpose of damping function without consideration for the combustion in the combustion chamber 200, therefore the liner cap 400 can effectively absorb the acoustic vibration. The air from the outer air source 415 may be a cooling air.

A greater understanding of the present invention and of its many advantages may be had from the following example, given by way of illustration. The following example is illustrative of some of the methods, applications, embodiments, and variants of the present invention. It is, of course, not to be considered as limiting the invention. Numerous changes and modifications can be made with respect to the invention.

Example 1

A gas turbine combustor according to an embodiment of the subject invention comprises a combustion chamber, a liner adjacent to the combustion chamber, a liner cap capping the combustion chamber, and a swirler cup passing through the liner cap, wherein the liner cap includes a first cavity having a first inlet, a second cavity having a first outlet facing the combustion chamber and a second outlet facing an outside of the combustion chamber, and an impingement plate between the first cavity and the second cavity. A longitudinal cross-sectional diagram of the gas turbine combustor of the subject invention is shown in FIG. 4.

The volume of the first cavity is 13,470,789 $mm^3$ and the volume of the second cavity is 1,579,933 $mm^3$. The first inlet of the first cavity has six holes, wherein each of the holes has a diameter of 20 mm. The impingement plate has 30 first through holes, wherein each of the first through holes has a diameter of 10 mm. The first outlet of the second cavity facing the combustion chamber has 3940 second through holes, wherein each of the second through holes has a diameter of 0.8 mm. The second outlet of the second cavity facing the outside of the combustion chamber has 60 third through holes, wherein each of the third through holes has a diameter of 5 mm.

Figure 8:
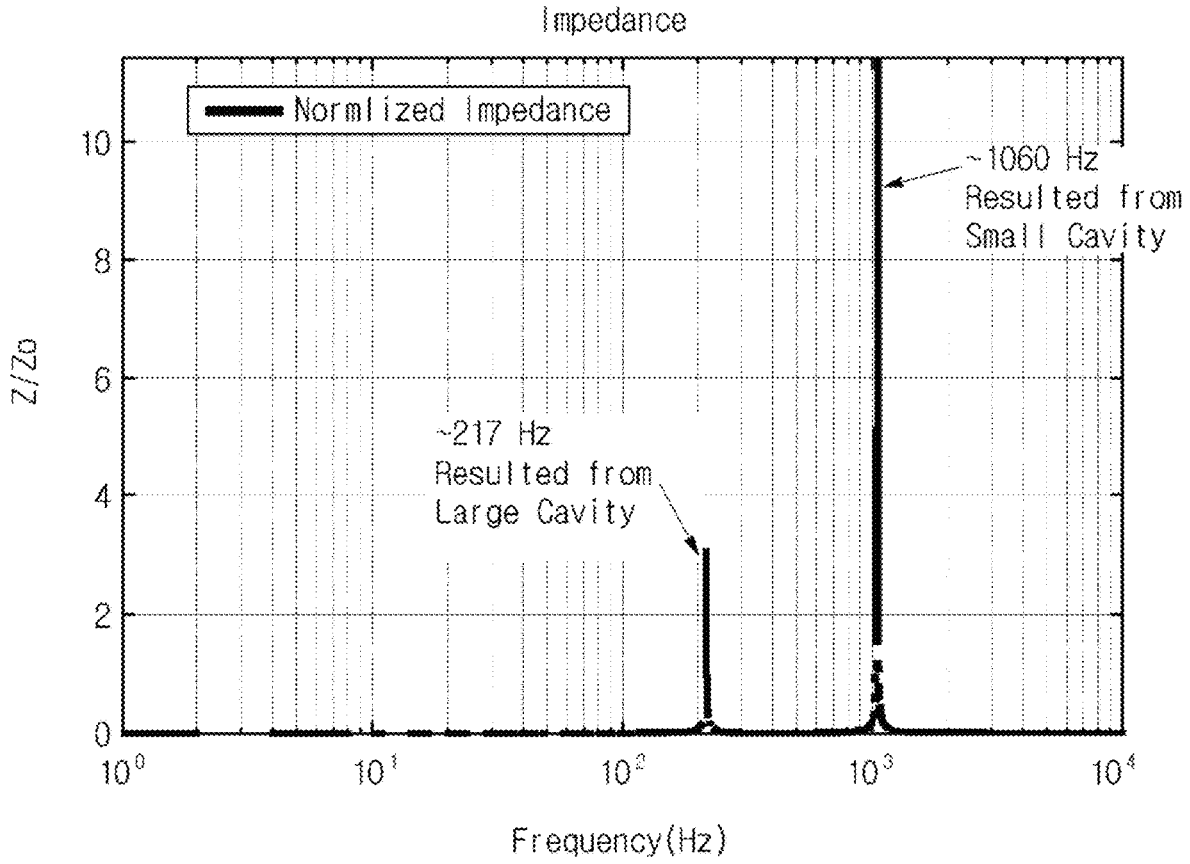
FIG. 8 is a graph showing a plurality of frequency peaks absorbed by a gas turbine combustor according to an embodiment.

Normalized Impedance of the liner cap according to the embodiment of the subject invention is shown in FIG. 8. Referring to FIG. 8, the liner cap absorbs an acoustic vibration having a lower frequency peak at 217 Hz and an acoustic vibration having a higher frequency peak at 1060 Hz. The lower frequency peak at 217 Hz corresponds to the first cavity having a large volume and the higher frequency peak at 1060 Hz corresponds to the second cavity having a small volume.

It should be understood that the examples and embodiments described herein are for illustrative purposes only and that various modifications or changes in light thereof will be suggested to persons skilled in the art and are to be included, within the spirit and purview of this application. Thus, the invention is not intended to limit the examples described herein, but is to be accorded the widest scope consistent with the principles and novel features disclosed herein.

What is claimed is:

1. A gas turbine combustor including a liner adjacent to a combustion chamber, the gas turbine combustor comprising:

a liner cap capping the combustion chamber and including:

a first cavity having a closed plate and a first inlet;

a second cavity having a first outlet communicating with the combustion chamber, the second cavity disposed opposite to the closed plate and separated from the first cavity by a first impingement plate; and a third cavity disposed between the first and second cavities and separated from the first cavity by a second impingement plate, wherein the liner cap forms an air passage from the first inlet to the first outlet through a sequential arrangement of the first cavity, the second impingement plate, the third cavity, the first impingement plate, and the second cavity.

2. The gas turbine combustor according to claim 1, wherein the first inlet communicates with the liner.

3. The gas turbine combustor according to claim 2, wherein the liner provides a compressed air to the first inlet.

4. The gas turbine combustor according to claim 1, further comprising a swirler cup having a cylinder shape that passes through the liner cap adjacent to the first cavity and the second cavity.

5. The gas turbine combustor according to claim 4, further comprising a fuel injector located in the swirler cup.

6. The gas turbine combustor according to claim 5, further comprising a vane located in an inside of the swirler cup and at an outside of the fuel injector.

7. The gas turbine combustor according to claim 6, wherein the vane provides an air supplied by the liner and a fuel supplied by the fuel injector to the combustion chamber through the swirler cup.

8. The gas turbine combustor according to claim 1, wherein a cooling gas is provided to the first inlet.

9. The gas turbine combustor according to claim 1, wherein the second impingement plate is configured to permit air within the first cavity to flow into the third cavity through a plurality of middle through holes formed in the second impingement plate, and wherein each of the middle through holes is smaller than the first inlet and is larger than each of a plurality of first through holes formed in the first impingement plate.

10. A gas turbine, comprising:

a combustion chamber;

a liner adjacent to the combustion chamber;

a liner cap capping the combustion chamber; and a swirler cup passing through the liner cap, wherein the liner cap comprises:

a first cavity having a closed plate and a first inlet;

a second cavity having a first outlet communicating with the combustion chamber, the second cavity disposed opposite to the closed plate and separated from the first cavity by a first impingement plate; and a third cavity disposed between the first and second cavities and separated from the first cavity by a second impingement plate, and wherein the liner cap forms an air passage from the first inlet to the first outlet through a sequential arrangement of the first cavity, the second impingement plate, the third cavity, the first impingement plate, and the second cavity.

11. The gas turbine according to claim 10, further comprising a turbine blade configured to receive a hot gas from the combustion chamber and a case encapsulating the liner cap and the swirler cup.

12. The gas turbine according to claim 11, wherein the liner provides a first portion of air to the first cavity and a second portion of air to the swirler cup.

* * * * *